US010734177B2

(12) United States Patent
Wu

(10) Patent No.: US 10,734,177 B2
(45) Date of Patent: Aug. 4, 2020

(54) ELECTROMAGNETIC RELAY DEVICE AND CONTROL METHOD THEREOF

(71) Applicant: MOXA INC., New Taipei (TW)

(72) Inventor: Kun-Nan Wu, New Taipei (TW)

(73) Assignee: Moxa Inc., New Taipei (TW)

( * ) Notice: Subject to any disclaimer, the term of this patent is extended or adjusted under 35 U.S.C. 154(b) by 469 days.

(21) Appl. No.: 15/711,009

(22) Filed: Sep. 21, 2017

(65) Prior Publication Data

US 2019/0088431 A1 Mar. 21, 2019

(51) Int. Cl.

*H01H 47/26* (2006.01)
*H01H 47/00* (2006.01)
*H01H 47/32* (2006.01)

(52) U.S. Cl.

CPC ..... *H01H 47/26* (2013.01); *H01H 47/002* (2013.01); *H01H 47/325* (2013.01); *H01H 2047/006* (2013.01)

(58) Field of Classification Search

CPC ..... H01H 47/00; H01H 47/02; H01H 47/04; H01H 47/22; H01H 47/32; H01F 27/42

USPC ..... 361/160–164, 170, 194, 93.2, 93.6, 23, 361/39, 153

See application file for complete search history.

(56) References Cited

U.S. PATENT DOCUMENTS 5,107,391 A * 4/1992 Siepmann ..... H01H 47/325 323/265
2002/0097542 A1* 7/2002 Perichon ..... H02H 7/30 361/63
2004/0145838 A1* 7/2004 Hazelton ..... G01R 31/50 361/23
2008/0186645 A1* 8/2008 Morimoto ..... H01H 47/325 361/194
2015/0200068 A1* 7/2015 Kinoshita ..... H01H 47/04 361/170

* cited by examiner

*Primary Examiner* — Tuan T Dinh
(74) *Attorney, Agent, or Firm* — Winston Hsu

(57) ABSTRACT

The present disclosure illustrates an electromagnetic relay device and a control method thereof. In the electromagnetic relay device, a control circuit respectively provides driving power to switch on the two electromagnetic relay units disposed adjacent to each other, and then provides the first holding power and the second holding power, lower than the driving power, to the two electromagnetic relay units after the two electromagnetic relay units are switched on, thereby maintaining the two electromagnetic relay units in the switched-on status. When the electromagnetic relay unit receiving the second holding power is tripped because of the environmental factor, the electromagnetic relay unit receiving the second holding power generates and outputs the trip feedback signal to the control circuit, so that the control circuit increases the first holding power upon receipt of the trip feedback signal. The second holding power is lower than or equal to the first holding power.

19 Claims, 3 Drawing Sheets

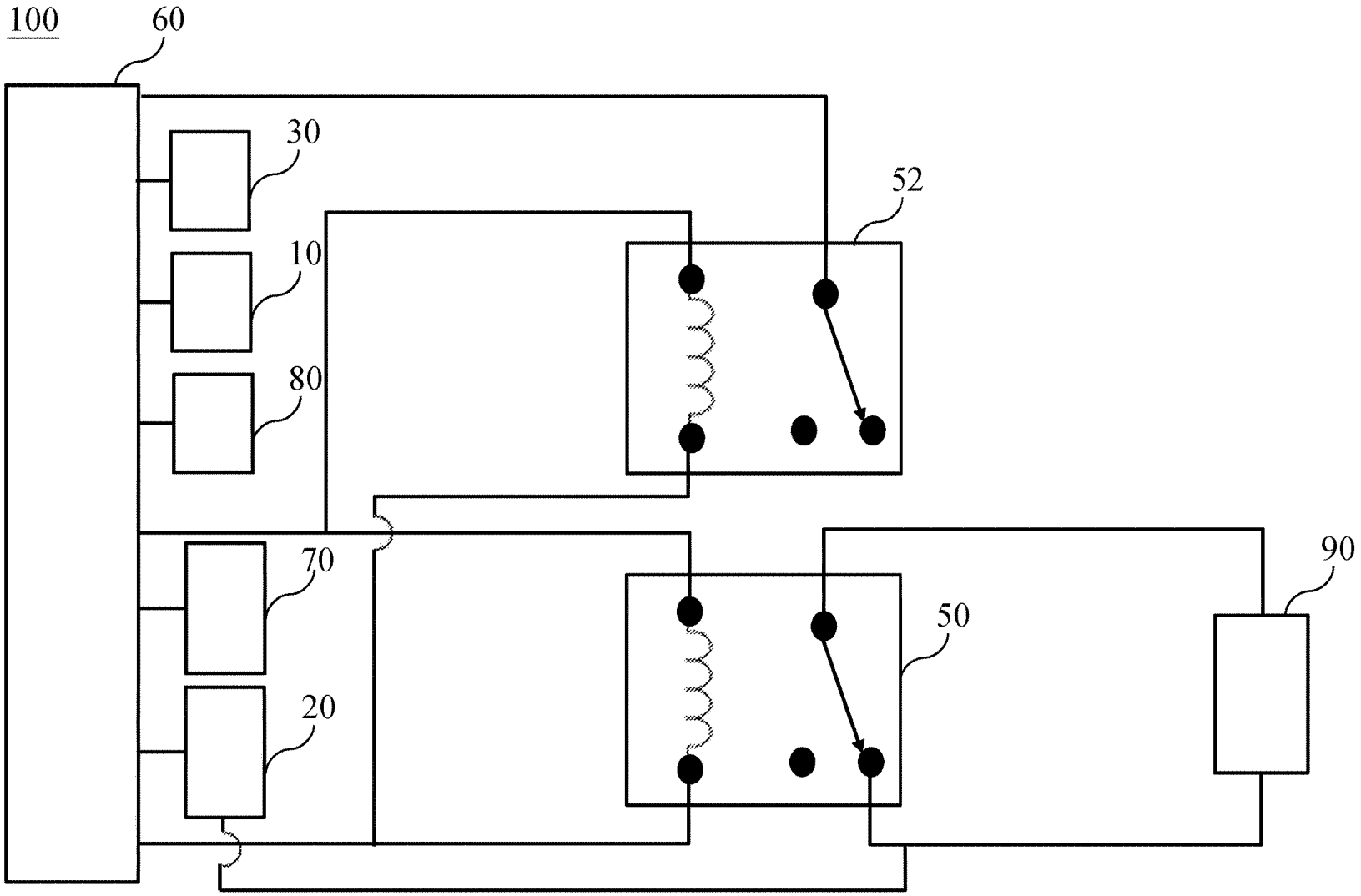
【FIG. 1】

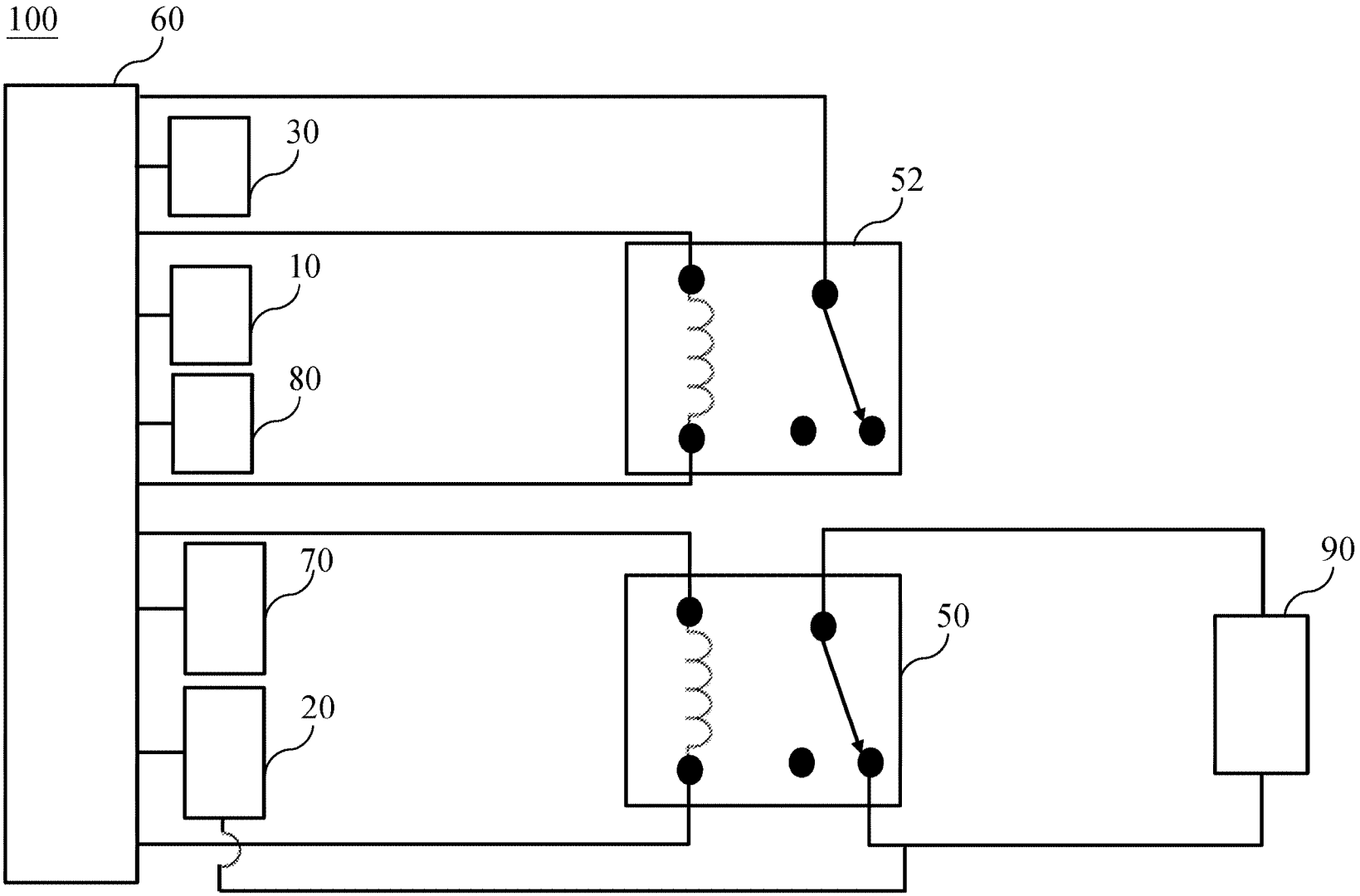
【FIG. 2】

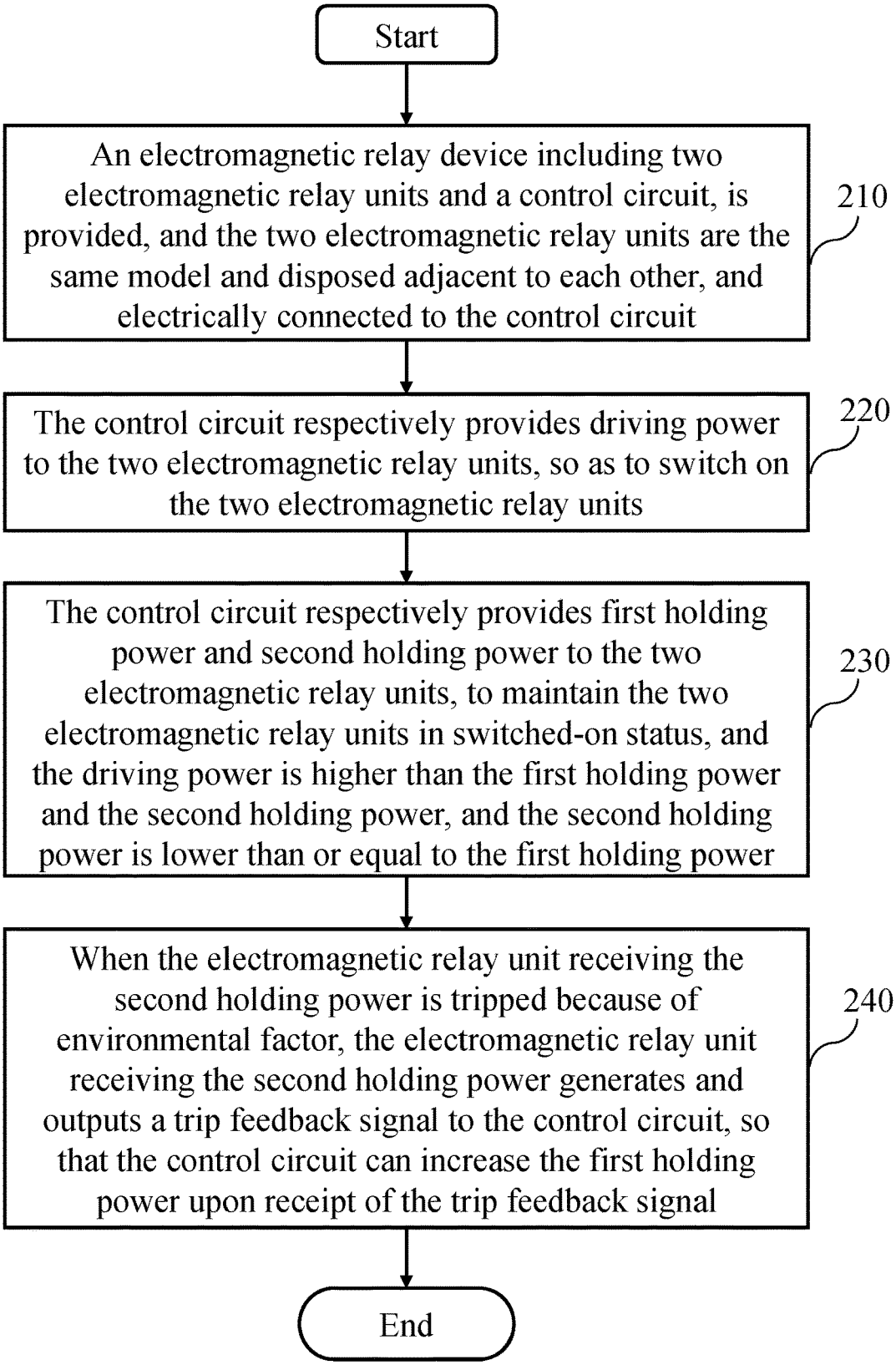
【 FIG. 3 】

ELECTROMAGNETIC RELAY DEVICE AND CONTROL METHOD THEREOF

BACKGROUND

1. Technical Field

The present disclosure relates to a relay device and a control method thereof, more particularly to an electromagnetic relay device and a control method thereof.

2. Description of Related Arts

In conventional control method for an electromagnetic relay unit, a control circuit is used to provide driving power to the electromagnetic relay unit to switch on the electromagnetic relay unit, and the control circuit keeps providing the driving power to the electromagnetic relay unit to maintain the electromagnetic relay unit in a switched-on status. However, the conventional control method causes high power consumption.

For this reason, a company develops a control circuit which provides holding power, which is lower than the driving power, to the electromagnetic relay unit to maintain its switched-on status after the electromagnetic relay unit is switched on, so as to reduce power consumption. However, the physical control property of the electromagnetic relay unit is easily affected by environmental change, so this control circuit for the electromagnetic relay unit is still hard to appropriately control the electromagnetic relay unit in response to the environmental change.

Therefore, what is need is to provide a technical solution to solve the conventional technology problem that the conventional control circuit for the electromagnetic relay unit is hard to appropriately control the electromagnetic relay unit in response to the environmental change resulting in poor reliability of the electromagnetic relay unit.

SUMMARY

In order to solve above-mentioned problem, the present disclosure is to provide an electromagnetic relay device and a control method thereof.

According to an embodiment, the present disclosure provides an electromagnetic relay device which includes two electromagnetic relay units and a control circuit. The two electromagnetic relay units are the same model and disposed adjacent to each other. The control circuit is electrically connected to the two electromagnetic relay units and configured to provide driving power to the two electromagnetic relay units to switch on the two electromagnetic relay units, and then provide first holding power and second holding power to the two electromagnetic relay unit respectively after the two electromagnetic relay units are switched on, so as to maintain the two electromagnetic relay units in switched-on status. The driving power is higher than the first holding power and the second holding power, and the second holding power is lower than or equal to the first holding power. When the electromagnetic relay unit receiving the second holding power is tripped because of an environmental factor, the electromagnetic relay unit receiving the second holding power generates and outputs a trip feedback signal to the control circuit, and the control circuit increases the first holding power upon receipt of the trip feedback signal.

According to an embodiment, the present disclosure provides a control method for an electromagnetic relay device, and the control method includes following steps: providing an electromagnetic relay device which comprises two electromagnetic relay units and a control circuit, wherein the two electromagnetic relay units are the same model and disposed adjacent to each other, and the control circuit is electrically connected to the two electromagnetic relay units; providing, by the control circuit, driving power to the two electromagnetic relay units to switch on the two electromagnetic relay units respectively; providing, by the control circuit, first holding power and second holding power to the two electromagnetic relay units respectively, to maintain the two electromagnetic relay units in switched-on status, wherein the driving power is higher than the first holding power and the second holding power, and the second holding power is lower than or equal to the first holding power; and when the electromagnetic relay unit receiving the second holding power is tripped because of an environmental factor, the electromagnetic relay unit receiving the second holding power generates and outputs a trip feedback signal to the control circuit, so that the control circuit increases the first holding power upon receipt of the trip feedback signal.

According to above-mentioned content, the difference between the present disclosure and the conventional technology is that the control circuit of the present disclosure respectively provides driving power to switch on the two electromagnetic relay units disposed adjacent to each other, and then provides the first holding power and the second holding power, which both are lower than the driving power, to the two electromagnetic relay units after the two electromagnetic relay units are switched on, thereby maintaining the two electromagnetic relay units in the switched-on status; and when the electromagnetic relay unit receiving the second holding power is tripped because of the environmental factor, the electromagnetic relay unit receiving the second holding power generates and outputs the trip feedback signal to the control circuit, so that the control circuit can increase the first holding power upon receipt of the trip feedback signal. The second holding power is lower than or equal to the first holding power.

By this technical means, the technical effect of improving reliability of the electromagnetic relay unit receiving the first holding power can be achieved.

BRIEF DESCRIPTION OF THE DRAWINGS

The structure, operating principle and effects of the present disclosure will be described in detail by way of various embodiments which are illustrated in the accompanying drawings.

FIG. 1 is a circuit diagram of an embodiment of an electromagnetic relay device the present disclosure.

FIG. 2 is a circuit diagram of other embodiment of the electromagnetic relay device of the present disclosure.

FIG. 3 is a flowchart showing the steps in an operation of an embodiment of a control method for the electromagnetic relay device of the present disclosure.

DETAILED DESCRIPTION

The following embodiments of the present invention are herein described in detail with reference to the accompanying drawings. These drawings show specific examples of the embodiments of the present invention. It is to be understood that these embodiments are exemplary implementations and are not to be construed as limiting the scope of the present invention in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be understood that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present invention. As used herein, the term "or" includes any and all combinations of one or more of the associated listed items.

The following refers to FIG. 1, which is a circuit diagram of an embodiment of an electromagnetic relay device of the present disclosure. An electromagnetic relay device 100 includes an electromagnetic relay unit 50, an electromagnetic relay unit 52 and a control circuit 60. The electromagnetic relay unit 50 and the electromagnetic relay unit 52 are the same model of electromagnetic relay units and disposed adjacent to each other. The control circuit 60 is electrically connected to the electromagnetic relay unit 50 and the electromagnetic relay unit 52. In this embodiment, the electromagnetic relay unit 50 and the electromagnetic relay unit 52 are electrically connected with each other in parallel, and electrically connected to the control circuit 60; in greater detail, an end of the electromagnetic relay unit 50 is electrically connected to the control circuit 60, and other end of the electromagnetic relay unit 50 is electrically connected to a load 90. Two ends of the electromagnetic relay unit 52 are electrically connected to the control circuit 60. The electromagnetic relay unit 50 and the electromagnetic relay unit 52 are connected in parallel with each other.

In this embodiment, the number of the electromagnetic relay units can be, but not limited to, two and can be adjusted upon practical demand. It should be noted that the electromagnetic relay device 100 at least includes two electromagnetic relay units, and at least one of the electromagnetic relay units is configured to transmit a trip feedback signal, and the other is configured to connect the load. Their detail description will be illustrated in following paragraphs.

The control circuit 60 is configured to provide driving power to the electromagnetic relay unit 50 and the electromagnetic relay unit 52 respectively, to switch on the electromagnetic relay unit 50 and the electromagnetic relay unit 52. Afterward the control circuit 60 provides first holding power to the electromagnetic relay unit 50, and provides second holding power to the electromagnetic relay unit 52, so that the electromagnetic relay unit 50 and the electromagnetic relay unit 52 can be kept being switched on; in other words, the electromagnetic relay unit 50 and the electromagnetic relay unit 52 are maintained in switched-on status. The driving power is higher than the first holding power and the second holding power, and the second holding power can be lower than or equal to the first holding power. In this embodiment, the electromagnetic relay unit 50 and the electromagnetic relay unit 52 are electrically connected in parallel with each other and connected to the control circuit 60, so the second holding power is equal to the first holding power.

After the electromagnetic relay unit 52 receiving the second holding power is tripped because of an environmental factor, the electromagnetic relay unit 52 receiving the second holding power generates and outputs a trip feedback signal to the control circuit 60, so that the control circuit 60 can increase the first holding power upon receipt of the trip feedback signal. Preferably, the trip feedback signal can be an interrupt signal or a polling signal; in greater detail, when the control circuit 60 is configured to periodically detect whether the electromagnetic relay unit 52 generates the trip feedback signal, the trip feedback signal can be the polling signal. Preferably, the detection cycle can be, but no limited to, 1 millisecond (ms). When the control circuit 60 does not continuously detect whether the electromagnetic relay unit 52 generates the trip feedback signal (that is, the control circuit 60 is passively noticed that the electromagnetic relay unit 52 generates the trip feedback signal), the trip feedback signal can be the interrupt signal. Preferably, the environmental factor can be vibration, but the present disclosure is not limited thereto, and the environmental factor can be changed upon practical demand; for example, the environmental factor can be electromagnetic field or temperature.

In this embodiment, the second holding power is equal to the first holding power, so the electromagnetic relay unit 50, which receives the first holding power, is also tripped by the environmental factor when the electromagnetic relay unit 52 receiving the second holding power is tripped by the environmental factor. Therefore, the way of the control circuit 60 increasing the first holding power upon receipt of the trip feedback signal indicates that the control circuit 60 respectively drives and switches on the electromagnetic relay unit 50 and the electromagnetic relay unit 52 again after the electromagnetic relay unit 50 and the electromagnetic relay unit 52 are tripped by the environmental factor, and the control circuit 60 then increases the first holding power and second holding power up to be higher than their previous values, so that the electromagnetic relay unit 50 and the electromagnetic relay unit 52 can be maintained in switched-on status, thereby preventing the electromagnetic relay unit 50 and the electromagnetic relay unit 52 from being tripped again by the environmental factor having similar value, and improving reliability of the electromagnetic relay unit which receives the first holding power and is connected to the load.

In this embodiment, each of the electromagnetic relay unit 50 and the electromagnetic relay unit 52 can be, but not limited to, a DC electromagnetic relay unit. When the electromagnetic relay unit 50 and the electromagnetic relay unit 52 are implemented by the DC electromagnetic relay units, the control circuit 60 can respectively provide a DC driving voltage to the electromagnetic relay unit 50 and the electromagnetic relay unit 52 first, so as to provide sufficient driving power to drive and switch on the electromagnetic relay unit 50 and the electromagnetic relay unit 52. Preferably, the DC driving voltage can be, but not limited to, 8 volt (V) and can be adjusted for different model of the DC electromagnetic relay unit. After the electromagnetic relay units are switched on, the switched-on status of the electromagnetic relay unit can be maintained by certain holding power lower than the driving power; for this reason, after the electromagnetic relay unit 50 and the electromagnetic relay unit 52 are switched on, the control circuit 60 can respectively provide the first holding power and the second holding power, which both are lower than the driving power, to the electromagnetic relay unit 50 and the electromagnetic relay unit 52 to maintain their switched-on statuses, thereby preventing power consumption. Preferably, the control circuit 60 can provide the first holding power and the second holding power according to a step-down voltage mode or a pulse width modulation (PWM) mode.

When the control circuit 60 provides the first holding power and the second holding power according to the step-down voltage mode, the control circuit 60 divides the DC driving voltage into several voltage stages and steps down the DC driving voltage according to the voltage stages, and maintains each voltage stages for a certain time during the step-down process, so that the control circuit 60 steps down the voltage until the voltage is just sufficient to provide the first holding power and the second holding power, thereby maintaining the electromagnetic relay unit 50 and the electromagnetic relay unit 52 in the switched-on status.

When the control circuit 60 provides the first holding power and the second holding power according to the PWM mode, the control circuit 60 provides the first holding power and the second holding power to the electromagnetic relay unit 50 and the electromagnetic relay unit 52 by PWM signals, thereby maintaining the electromagnetic relay unit 50 and the electromagnetic relay unit 52 in the switched-on status. In this embodiment, an average voltage of the PWM signal can be, but not limited to, 2V; a duty cycle of the PWM signal can be, but not limited to, 25%; a frequency of the PWM signal can be, but not limited to, 20 KHz. The present disclosure is not limited to this embodiment, and the properties of the PWM signal can be adjusted for the electromagnetic relay unit in practical application.

Furthermore, when the electromagnetic relay device 100 is disposed in different posture, the effect caused by gravity on the electromagnetic relay device 100 may be different; for this reason, the electromagnetic relay device 100 may include a posture sensing unit 70 connected to the control circuit 60 and configured to sense the posture of the electromagnetic relay device 100, and when the posture sensing unit 70 senses that the posture of the electromagnetic relay device 100 is changed, the posture sensing unit 70 outputs a posture feedback signal to the control circuit 60, so that the control circuit 60 can adjust the first holding power and the second holding power upon receipt of the posture feedback signal. As a result, when the electromagnetic relay device 100 is disposed in a posture where the gravity affects the electromagnetic relay device 100 more significantly, the control circuit 60 can increase the first holding power and the second holding power; when the electromagnetic relay device 100 is disposed in a posture where the gravity affects the electromagnetic relay device 100 less significantly, the control circuit 60 can decrease the first holding power and the second holding power, thereby adjusting the sensing threshold value of the electromagnetic relay unit 52 which receives the second holding power, and increasing reliability of the electromagnetic relay unit 50 which is connected to the load and receives the first holding power. The second holding power is positively correlated with the sensing threshold value.

Furthermore, the coil property of the electromagnetic relay unit may be affected by temperature, so the electromagnetic relay device 100 may include a temperature sensing unit 80 electrically connected to the control circuit 60 and configured to sense the temperature of the electromagnetic relay device 100, The temperature sensing unit 80 generates and outputs a temperature feedback signal to the control circuit 60, so that the control circuit 60 can adjust the first holding power and the second holding power upon receipt of the temperature feedback signal. As a result, when the temperature of the electromagnetic relay device 100 increases, the control circuit 60 can increase the first holding power and the second holding power; when the temperature of the electromagnetic relay device 100 decreases, the control circuit 60 can decrease the first holding power and the second holding power, thereby adjusting the sensing threshold value of the electromagnetic relay unit 52 receiving the second holding power, and increasing reliability of the electromagnetic relay unit 50 which is connected to the load and receives the first holding power. The second holding power is positively correlated with the sensing threshold value.

When the electromagnetic relay device 100 bears excessively high temperature or excessively high vibration, or these events occurs at the same time, the control circuit 60 can determine whether the coils of the electromagnetic relay unit 50 and the electromagnetic relay unit 52 are operated beyond a rated operating condition. If the coils of the electromagnetic relay unit 50 and the electromagnetic relay unit 52 are operated beyond the rated operating condition, the control circuit 60 can instantly notice an upper level system (not shown in figures), so that the upper level system can perform necessary response, for example, the upper level system can decrease the system load or limit the environmental vibration, temperature or electromagnetic field to prevent danger, thereby improving reliability of overall system.

In this embodiment, besides the temperature sensing unit 80 and the posture sensing unit 70, the electromagnetic relay device may include other sensors, such as a sound sensing unit 10, a current sensing unit 20 and a magnetic field sensing unit 30, so that the control circuit 60 can adjust the first holding power and the second holding power upon receipt of the feedback signals transmitted from these sensing units, thereby improving reliability of the electromagnetic relay unit 50 which is connected to the load. In greater detail, when the electromagnetic relay device 100 includes the sound sensing unit 10 connected to the control circuit 60, the sound sensing unit 10 is configured to sense whether the electromagnetic relay unit 52 generates bounce sound, and if the sound sensing unit 10 senses the bounce sound generated by the electromagnetic relay unit 52, it indicates that the electromagnetic relay unit 52 is tripped, the sound sensing unit 10 outputs a sound feedback signal to the control circuit 60, so that the control circuit 60 can increase the first holding power and the second holding power upon receipt of the sound feedback signal. When the electromagnetic relay device 100 includes the current sensing unit 20 connected to the control circuit 60 and the electromagnetic relay unit 50, the current sensing unit 20 is configured to sense a load current of the electromagnetic relay unit 50 to determine whether a load contact shrapnel of the electromagnetic relay unit 50 is in poor contact or is tripped, and when the current sensing unit 20 determines that the load contact shrapnel of the electromagnetic relay unit 50 is in poor contact or is tripped, it indicates that the load current is transiently changed, the current sensing unit 20 can output a current feedback signal to the control circuit 60, so that the control circuit 60 can increase the first holding power and the second holding power upon receipt of the current feedback signal. When the electromagnetic relay device 100 includes the magnetic field sensing unit 30 connected to the control circuit 60, the magnetic field sensing unit 30 is configured to sense the magnetic field of the electromagnetic relay device 100, and when the magnetic field sensing unit 30 senses a change in the magnetic field of the electromagnetic relay device 100, the magnetic field sensing unit 30 generates and outputs a magnetic field feedback signal to the control circuit 60, so that the control circuit 60 can adjust the first holding power and the second holding power upon receipt of the magnetic field feedback signal; for example, when the magnetic field of the electromagnetic relay device 100 becomes higher, the control circuit 60 increases the first holding power and the second holding power; when the magnetic field of the electromagnetic relay device 100 becomes lower, the control circuit 60 decreases the first holding power and the second holding power.

Preferably, the sound sensing unit 10, the current sensing unit 20, the magnetic field sensing unit 30, the posture sensing unit 70 and the temperature sensing unit 80 can be, but not limited to, sensors manufactured by Micro Electro Mechanical Systems (MEMS) process, so as to reduce power consumption.

The following refers to FIG. 2, which is a circuit diagram of other embodiment of the electromagnetic relay device of the present disclosure. The main difference between this embodiment and previous embodiment is that the electromagnetic relay unit 50 and the electromagnetic relay unit 52 of this embodiment are individually connected to the control circuit 60, but the electromagnetic relay unit 50 and the electromagnetic relay unit 52 of previous embodiment are connected in parallel with each other and connected to the control circuit 60.

In this embodiment, the control circuit 60 respectively provides driving power to the electromagnetic relay unit 50 and the electromagnetic relay unit 52, so as to switch on the electromagnetic relay unit 50 and the electromagnetic relay unit 52. Next, the control circuit 60 provides the first holding power to the electromagnetic relay unit 50, and the second holding power to the electromagnetic relay unit 52 respectively, so that the electromagnetic relay unit 50 and the electromagnetic relay unit 52 can be maintained in the switched-on status. The driving power is higher than the first holding power and the second holding power, and the second holding power can be lower than or equal to the first holding power. In this embodiment, the electromagnetic relay unit 50 and the electromagnetic relay unit 52 are individually connected to the control circuit 60, so the second holding power can be lower than the first holding power.

When the electromagnetic relay unit 52 receiving the second holding power is tripped because of the environmental factor, the electromagnetic relay unit 52 receiving the second holding power generates the trip feedback signal to the control circuit, so that the control circuit 60 increases the first holding power upon receipt of the trip feedback signal.

In this embodiment, the second holding power is lower than the first holding power, so the electromagnetic relay unit 50 receiving the first holding power is not tripped when the electromagnetic relay unit 52 receiving the second holding power is tripped; for this reason, that the control circuit 60 of this embodiment increases the first holding power upon receipt of the trip feedback signal, indicates that after the electromagnetic relay unit 52 is tripped, the control circuit 60 increases the first holding power upon receipt of the trip feedback signal to maintain the electromagnetic relay unit 50 in the switched-on status, so as to prevent the electromagnetic relay unit 50 from being tripped under the same condition, thereby improving reliability of the electromagnetic relay unit which receives the first holding power and is connected to the load. It should be noted that when the control circuit 60 increases the first holding power upon receipt of the trip feedback signal to maintain the electromagnetic relay unit 50 in the switched-on status, the control circuit 60 can provide driving power to switch on the electromagnetic relay unit 52 again, and the control circuit 60 then provide the second holding power, which is higher than previous value, to maintain the electromagnetic relay unit 52 in the switched-on status. The increased second holding power is still lower than the increased first holding power. In other words, whenever the electromagnetic relay unit 52 is tripped because of the environmental factor, the control circuit 60 can increase the first holding power and the second holding power upon receipt of trip feedback signal, so as to prevent the electromagnetic relay unit 50 and the electromagnetic relay unit 52 from being tripped again under the same environmental condition, thereby adjusting the sensing threshold value of the electromagnetic relay unit 52 receiving the second holding power and increasing reliability of the electromagnetic relay unit 50 which is connected to the load and receives the first holding power. The second holding power is positively correlated with the sensing threshold value.

In this embodiment, each of the electromagnetic relay units 50 and 52 can be an AC electromagnetic relay unit, and when the electromagnetic relay unit 50 and the electromagnetic relay unit 52 both are AC electromagnetic relay units, the control circuit 60 can provide AC signal to the electromagnetic relay unit 50 and the electromagnetic relay unit 52, so as to provide sufficient driving power to drive and switch on the electromagnetic relay unit 50 and the electromagnetic relay unit 52 respectively, and next, the control circuit 60 can decrease amplitude and frequency of the AC signal to provide the first holding power and the second holding power, which both are lower than the driving power, to the electromagnetic relay unit 50 and the electromagnetic relay unit, thereby maintaining the electromagnetic relay unit 50 and the electromagnetic relay unit 52 in the switched-on status and preventing power consumption. Preferably, the AC signal can be a general AC signal, or a half wave rectified signal outputted from a half-wave rectifier which rectifies the general AC signal. The power of the AC signal is proportional to the square of the amplitude of the AC signal, and the frequency of the AC signal is in positively linear relation with the power of the AC signal.

The following refers to FIG. 3, which is a flowchart showing the steps in an operation of an embodiment of a control method for the electromagnetic relay device of the present disclosure. The control method includes following steps. In a step 210, an electromagnetic relay device, which includes two electromagnetic relay units and a control circuit, is provided, and the two electromagnetic relay units are the same model and disposed adjacent to each other, and electrically connected to the control circuit. In a step 220, the control circuit respectively provides driving power to the two electromagnetic relay units, so as to switch on the two electromagnetic relay units. In a step 230, the control circuit respectively provides first holding power and second holding power to the two electromagnetic relay units, to maintain the two electromagnetic relay units in switched-on status, and the driving power is higher than the first holding power and the second holding power, and the second holding power can be lower than or equal to the first holding power. In a step 240, when the electromagnetic relay unit receiving the second holding power is tripped because of environmental factor, the electromagnetic relay unit receiving the second holding power generates and outputs a trip feedback signal to the control circuit, so that the control circuit can increase the first holding power upon receipt of the trip feedback signal. Through aforementioned steps, after the control circuit respectively provides driving power to the two electromagnetic relay units to switch on the two electromagnetic relay units, the control circuit individually provides the first holding power and the second holding power, which both are lower than the driving power, to the two electromagnetic relay units to maintain the two electromagnetic relay units in the switched-on status; when the electromagnetic relay unit receiving the second holding power is tripped because of the environmental factor, the electromagnetic relay unit receiving the second holding power can generate and output the trip feedback signal to the control circuit, so that the control circuit increases the first holding power upon receipt of the trip feedback signal, thereby achieving technical effect of improving reliability of the electromagnetic relay unit which receives the first holding power.

When the two electromagnetic relay units are electrically connected in parallel with each other and both are electrically connected to the control circuit, the second holding power is equal to the first holding power; when the two electromagnetic relay units are individually connected to the control circuit, the second holding power can be lower than or equal to the first holding power.

Furthermore, in this embodiment, the step of using the control circuit to provide the first holding power and the second holding power to two electromagnetic relay units, may include a step of using the control circuit to provide the first holding power and the second holding power to the two electromagnetic relay units by a PWM mode. The manner of providing power by PWM mode is described in aforementioned paragraphs, so its detailed description is not repeated here.

Furthermore, in this embodiment, the control method for the electromagnetic relay device may further include a step of using a posture sensing unit, which is electrically connected to the control circuit, to sense a posture of the electromagnetic relay device, and outputting a posture feedback signal to the control circuit when the posture sensing unit senses that the posture of the electromagnetic relay device is changed, so as to enable the control circuit to adjust the first holding power and the second holding power upon receipt of the posture feedback signal. The manner of using the posture sensing unit is described in aforementioned paragraphs, so its detailed description is not repeated here.

In this embodiment, the control method for the electromagnetic relay device may further include a step of: using a temperature sensing unit, which is electrically connected to the control circuit, to sense a temperature of the electromagnetic relay device; and outputting a temperature feedback signal to the control circuit after temperature of the electromagnetic relay device is changed, so as to enable the control circuit to adjust the first holding power and the second holding power upon receipt of the temperature feedback signal. The manner of using the temperature sensing unit is described in aforementioned paragraphs, so its detailed description is not repeated here.

In this embodiment, the control method for the electromagnetic relay device may further include a step of: using a sound sensing unit, which is electrically connected to the control circuit, to sense bounce sound generated by the electromagnetic relay unit receiving the second holding power; and outputting a sound feedback signal to the control circuit after the sound sensing unit senses the bounce sound of the electromagnetic relay unit, so as to enable the control circuit to adjust the first holding power and the second holding power upon receipt of the sound feedback signal. The manner of using the sound sensing unit is described in aforementioned paragraphs, so its detailed description is not repeated here.

Furthermore, in this embodiment, the control method for the electromagnetic relay device may further include a step of: using a current sensing unit, which is electrically connected to the control circuit and the electromagnetic relay unit receiving the first holding power, to receive a load current of the electromagnetic relay unit, which receives the first holding power, to determine whether a load contact shrapnel of the electromagnetic relay unit receiving the first holding power is in poor contact or is tripped; and outputting a current feedback signal to the control circuit after the current sensing unit determines that the load contact shrapnel is in poor contact or is tripped, so as to enable the control circuit to increase the first holding power and the second holding power upon receipt of the current feedback signal. The manner of using the current sensing unit is described in aforementioned paragraphs, so its detailed description is not repeated here.

Furthermore, in this embodiment, the control method for the electromagnetic relay device may further include a step of: using a magnetic field sensing unit, which is electrically connected to the control circuit, to sense magnetic field of the electromagnetic relay device, and outputting a magnetic field feedback signal to the control circuit after the magnetic field sensing unit senses the change in the magnetic field of the electromagnetic relay device, so as to enable the control circuit to adjust the first holding power and the second holding power upon receipt of the magnetic field feedback signal. The manner of using the magnetic field sensing unit is described in aforementioned paragraphs, so its detailed description is not repeated here.

To summarize, the difference between the present disclosure and the conventional technology is that the control circuit of the present disclosure respectively provides driving power to switch on the two electromagnetic relay units disposed adjacent to each other, and then provides the first holding power and the second holding power, which both are lower than the driving power, to the two electromagnetic relay units after the two electromagnetic relay units are switched on, thereby maintaining the two electromagnetic relay units in the switched-on status; and the second holding power and the first holding power are lower than the driving power to prevent power consumption; and when the electromagnetic relay unit receiving the second holding power is tripped because of the environmental factor, the electromagnetic relay unit receiving the second holding power generates and outputs the trip feedback signal to the control circuit, so that the control circuit can increase the first holding power upon receipt of the trip feedback signal. By this technical means, the conventional technology problem can be solved, and the technical effect of improving reliability of the electromagnetic relay unit receiving the first holding power can be achieved.

Furthermore, the electromagnetic relay device of the present disclosure can include the temperature sensing unit, the posture sensing unit, the sound sensing unit, the current sensing unit or the magnetic field sensing unit, to adjust the sensing threshold value of the electromagnetic relay unit receiving the second holding power, and improve reliability of the electromagnetic relay unit receiving the first holding power.

The present disclosure disclosed herein has been described by means of specific embodiments. However, numerous modifications, variations and enhancements can be made thereto by those skilled in the art without departing from the spirit and scope of the invention set forth in the claims.

What is claimed is:

1. An electromagnetic relay device, comprising:

two electromagnetic relay units, being the same model and disposed adjacent to each other; and a control circuit electrically connected to the two electromagnetic relay units and configured to provide a driving power to the two electromagnetic relay units to switch on the two electromagnetic relay units, and then provide a first holding power and a second holding power to the two electromagnetic relay units respectively after the two electromagnetic relay units are switched on, so as to maintain the two electromagnetic relay units in switched-on status, wherein the driving power is higher than the first holding power and the second holding power, and the second holding power is lower than or equal to the first holding power;

wherein the electromagnetic relay unit receiving the second holding power is tripped because of an environmental factor, the electromagnetic relay unit receiving the second holding power generates and outputs a trip feedback signal to the control circuit, and the control circuit increases the first holding power upon receipt of the trip feedback signal.

2. The electromagnetic relay device according to claim 1, wherein the two electromagnetic relay units are electrically connected in parallel with each other and connected to the control circuit, the second holding power is equal to the first holding power.

3. The electromagnetic relay device according to claim 1, wherein the two electromagnetic relay units are electrically connected to the control circuit individually, the second holding power is lower than or equal to the first holding power.

4. The electromagnetic relay device according to claim 1, wherein the two electromagnetic relay units are AC electromagnetic relay units or DC electromagnetic relay units.

5. The electromagnetic relay device according to claim 1, wherein the control circuit provides the first holding power and the second holding power according to a step-down voltage mode or a pulse width modulation (PWM) mode.

6. The electromagnetic relay device according to claim 1, further comprising a posture sensing unit electrically connected to the control circuit and configured to sense a posture of the electromagnetic relay device, wherein when the posture sensing unit senses a change in the posture of the electromagnetic relay device, the posture sensing unit outputs a posture feedback signal to the control circuit, so that the control circuit adjusts the first holding power and the second holding power upon receipt of the posture feedback signal.

7. The electromagnetic relay device according to claim 1, further comprising a temperature sensing unit electrically connected to the control circuit and configured to sense a temperature of the electromagnetic relay device, wherein when the temperature of the electromagnetic relay device is changed, the temperature sensing unit outputs a temperature feedback signal to the control circuit, so that the control circuit adjusts the first holding power and the second holding power upon receipt of the temperature feedback signal.

8. The electromagnetic relay device according to claim 1, further comprising a sound sensing unit electrically connected to the control circuit and configured to sense bounce sound generated by the electromagnetic relay unit receiving the second holding power, wherein when the sound sensing unit senses the bounce sound generated by the electromagnetic relay unit receiving the second holding power, the sound sensing unit outputs a sound feedback signal to the control circuit, so that the control circuit increases the first holding power and the second holding power upon receipt of the sound feedback signal.

9. The electromagnetic relay device according to claim 1, further comprising a current sensing unit electrically connected to the control circuit and the electromagnetic relay unit receiving the first holding power, and configured to receive a load current of the electromagnetic relay unit receiving the first holding power to determine whether a load contact shrapnel of the electromagnetic relay unit receiving the first holding power is in poor contact or is tripped, wherein when the current sensing unit determines that the load contact shrapnel is in poor contact or is tripped, the current sensing unit outputs a current feedback signal to the control circuit, so that the control circuit increases the first holding power and the second holding power upon receipt of the current feedback signal.

10. The electromagnetic relay device according to claim 1, further comprising a magnetic field sensing unit electrically connected to the control circuit and configured to sense magnetic field of the electromagnetic relay device, wherein when the magnetic field sensing unit senses a change in the magnetic field of the electromagnetic relay device, the magnetic field sensing unit outputs a magnetic field feedback signal to the control circuit, so that the control circuit adjusts the first holding power and the second holding power upon receipt of the magnetic field feedback signal.

11. A control method for an electromagnetic relay device, comprising:

providing an electromagnetic relay device which comprises two electromagnetic relay units and a control circuit, wherein the two electromagnetic relay units are the same model and disposed adjacent to each other, and the control circuit is electrically connected to the two electromagnetic relay units;

providing, by the control circuit, a driving power to the two electromagnetic relay units to switch on the two electromagnetic relay units respectively;

providing, by the control circuit, a first holding power and a second holding power to the two electromagnetic relay units respectively, to maintain the two electromagnetic relay units in switched-on status, wherein the driving power is higher than the first holding power and the second holding power, and the second holding power is lower than or equal to the first holding power; and wherein the electromagnetic relay unit receiving the second holding power is tripped because of an environmental factor, the electromagnetic relay unit receiving the second holding power generates and outputs a trip feedback signal to the control circuit, so that the control circuit increases the first holding power upon receipt of the trip feedback signal.

12. The control method claim 11, wherein the step of providing, by the control circuit, the first holding power and the second holding power to the two electromagnetic relay units, further comprises:

respectively providing, by the control circuit, the first holding power and the second holding power to the two electromagnetic relay units according to a pulse width modulation (PWM) mode or a step-down voltage mode.

13. The control method according to claim 11, wherein the two electromagnetic relay unit are electrically connected in parallel with each other and electrically connected to the control circuit, the second holding power is equal to the first holding power.

14. The control method according to claim 11, wherein the two electromagnetic relay units are individually connected to the control circuit, the second holding power is lower than or equal to the first holding power.

15. The control method according to claim 11, further comprising:

using a posture sensing unit, which is electrically connected to the control circuit, to sense a posture of the electromagnetic relay device;

outputting a posture feedback signal, from the posture sensing unit, to the control circuit when the posture sensing unit senses a change in the posture of the electromagnetic relay device; and adjusting, by the control circuit, the first holding power and the second holding power upon receipt of the posture feedback signal.

16. The control method according to claim 11, further comprising:

using a temperature sensing unit, which is electrically connected to the control circuit, to sense a temperature of the electromagnetic relay device;

outputting a temperature feedback signal, from the temperature sensing unit, to the control circuit when the temperature of the electromagnetic relay device is changed; and adjusting, by the control circuit, the first holding power and the second holding power upon receipt of the temperature feedback signal.

17. The control method according to claim 11, further comprising:

using a sound sensing unit, which is electrically connected to the control circuit, to sense whether the electromagnetic relay unit receiving the second holding power generates bounce sound;

outputting a sound feedback signal, from the sound sensing unit, to the control circuit when the sound sensing unit senses the bounce sound generated by the electromagnetic relay unit receiving the second holding power; and increasing, by the control circuit, the first holding power and the second holding power upon receipt of the sound feedback signal.

18. The control method according to claim 11, further comprising:

using a current sensing unit, which is electrically connected to the control circuit and the electromagnetic relay unit receiving the first holding power, to receive a load current of the electromagnetic relay unit receiving the first holding power, to determine whether a load contact shrapnel of the electromagnetic relay unit receiving the first holding power is in poor contact or is tripped;

outputting a current feedback signal, from the current sensing unit, to the control circuit when the current sensing unit determines that the load contact shrapnel is in poor contact or is tripped, and increasing, by the control circuit, the first holding power and the second holding power upon receipt of the current feedback signal.

19. The control method according to claim 11, further comprising:

using a magnetic field sensing unit, which is electrically connected to the control circuit, to sense magnetic field of the electromagnetic relay device;

outputting a magnetic field feedback signal, from the magnetic field sensing unit, to the control circuit when the magnetic field sensing unit senses a change in the magnetic field; and adjusting, by the control circuit, the first holding power and the second holding power upon receipt of the magnetic field feedback signal.

* * * * *